US006267156B1

(12) United States Patent
Argandona

(10) Patent No.: US 6,267,156 B1
(45) Date of Patent: Jul. 31, 2001

(54) FILLING STATION EQUIPMENT FOR FUMES EMISSION PREVENTION

(76) Inventor: Toby Argandona, 21221 Running Branch Rd., Diamond Bar, CA (US) 91765

( * ) Notice: Subject to any disclaimer, the term of this patent is extended or adjusted under 35 U.S.C. 154(b) by 0 days.

(21) Appl. No.: 09/587,251

(22) Filed: Jun. 2, 2000

(51) Int. Cl.[7] ..... B65B 1/04

(52) U.S. Cl. ..... 141/86; 220/571

(58) Field of Search ..... 141/86–88, 311 A; 220/571; 405/52, 53, 128, 129

(56) References Cited

U.S. PATENT DOCUMENTS

| | | | | |
|---|---|---|---|---|
| 4,896,705 | * | 1/1990 | Podgers et al. | 141/86 |
| 4,960,346 | * | 10/1990 | Tamayo | 141/86 |
| 5,222,832 | * | 6/1993 | Sunderhaus et al. | 141/86 |
| 5,372,453 | | 12/1994 | Argandona . | |

* cited by examiner

*Primary Examiner*—Steven O. Douglas
(74) *Attorney, Agent, or Firm*—Boniard I. Brown

(57) ABSTRACT

Filling station equipment eliminates or reduces fumes emission by the provision of a drop tube which extends below the surface level of fuel in an underground tank, and by provision of a seal between the drop tube and a riser pipe, thus to prevent passage and emission of fumes between the drop tube and the riser pipe.

16 Claims, 2 Drawing Sheets

FILLING STATION EQUIPMENT FOR FUMES EMISSION PREVENTION

BACKGROUND AND SUMMARY OF THE INVENTION

Gasoline filling station equipment typically comprises an underground fuel tank, a drop tube extending from the tank upwardly to a containment box with a containment valve at the containment box. The drop tube has long been intended to serve to reduce fumes emission.

Filling stations typically utilize individual customer dispensers for filling vehicle tanks. Vacuum assist systems have been provided to assist customers in maintaining effective sealing between dispensing nozzles and vehicle tank openings. Such systems provide a partial vacuum to assist such engagement. The vacuum system draws fuel fumes from the region of the dispensers in vehicle tanks to the underground tank.

The underground tank becomes pressurized by the cumulative effect of vapors produced therein, and from the filling of the tank via the drop tube by splashing and agitation. The build-up of vapors and pressure causes emission of vapors via the drop tube. Also, fuel vapors are produced and emitted at the containment box by any excess fluid therein. Fumes and vapor pressure prevent drainage of excess fluid via the drop tube to the tank. Pressure and vapors in the underground tank and the drop tube tend to prevent the drainage of excess fluid to the tank from the containment box, particularly when the gasoline or fuel is warmed, as on summer days when the temperature of the gasoline may be 85°– 90°. The containment valve at the containment box is effectively inoperative when pressure is exerted therebelow. It is to be noted that it is illegal to operate any valve to relieve pressure in an underground tank of over 3" of water pressure.

Drop tubes of prior art systems typically terminate above the gasoline level in the underground tank, so that during input of fuel to the tank, splashing and agitation produce vapors and pressure in the tank which are emitted.

The present invention substantially prevents fumes emission by the provision of a drop tube which extends to a level below the surface of liquid fuel in the underground tank, thus eliminating fumes production by splashing and agitating the liquid fuel, particularly during filling operations and filling of the tank; fumes emission via the passage defined by the concentric drop tube and riser pipe by the sealing of the upper portions of the drop tube and riser pipe.

DESCRIPTION OF THE PREFERRED EMBODIMENT

Figure 1:
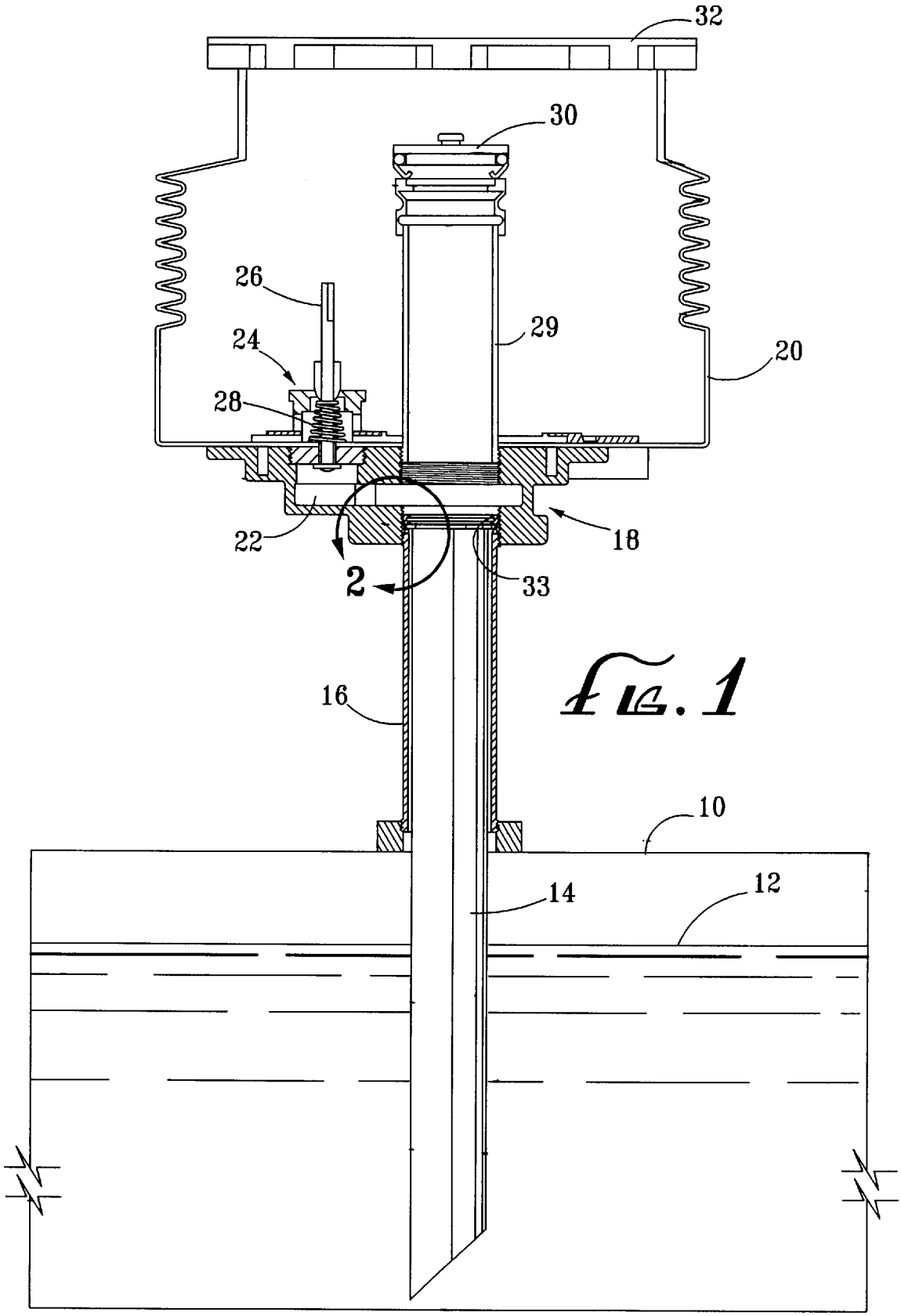
FIG. 1 is a sectional view of gasoline filling station equipment wherein a drop tube extends below liquid in the tank and the drop tube and a riser pipe are sealed to prevent passage of fumes therebetween.

Referring to the drawings, there is illustrated gasoline filling station equipment with which the present invention is utilized.

A fuel tank 10 contains gasoline to a level indicated at 12. A drop tube 14 extends well below the level of the fuel, and typically to within 4" of the bottom of the tank. The drop tube extends upwardly with its upper end portion in engagement with a base mounting structure 18 for a containment box 20. A riser 16 is disposed concentrically about drop tube 14 and extends from the top of the tank 10 into engagement with the mounting structure 18, as shown.

Mounting structure 18 has a passage 22 therein, and an opening wherein is mounted a containment valve 24 which has a handle 26 manually operable to depress a spring 28 to effect flow via passage 22 to drop line 14, and thence to the underground tank.

An intake pipe 29 is threadedly engaged in the mounting structure 18, as shown, and is closed by a cap 30. A manhole cover 32 is positioned atop the containment box and is disposed at ground surface.

Figure 2:
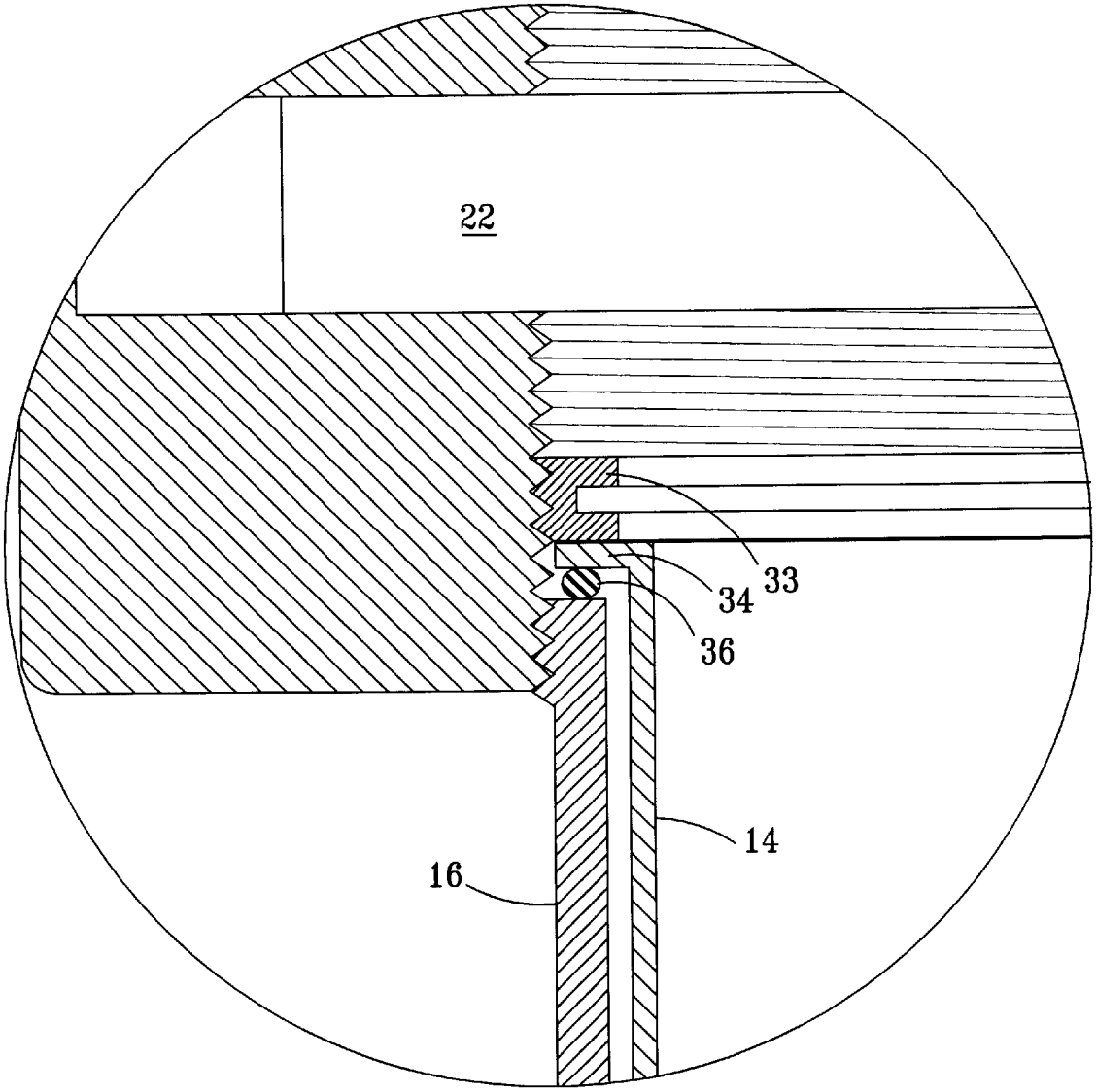
FIG. 2 is an enlarged view of a portion of FIG. 1 encircled by arrow 2.

Referring to FIG. 2, a jam nut 33 is threadedly mounted in the base structure 18 and is rotatable into engagement with a radially extending flange 34 of the drop tube to compress a resilient annular seal 36 between flange 34 and the upper end of the riser 16.

The sealing between the drop tube and riser causes any overfill of fuel to pass downwardly to the tank only via the large diameter drop tube, rather than via the limited annular passage between the drop tube and riser, as in prior art. Flow thus passes quickly downwardly via the drop tube, without any significant vapors or fumes being produced. The sealing arrangement between the riser and drop tube prevents vapor from rising and escaping into atmosphere, as when the drain containment valve 24 is operated, or when fill cap 30 is removed from the intake tube 29, as by the tank truck operator. Any vapor pressure above the gasoline level in the tank is prevented from rising between the drop tube and riser.

The drop tube of the invention extends well below the level 12 of liquid in the underground tank. Incoming fuel does not impact the surface of the liquid at 12, thus splashing, agitation, etc., do not occur thus eliminating the production of vapors and fumes, which develop from drop tubes of the prior art which terminate above the liquid surface, producing vapors and fumes. Little or no fumes or pressure occur above the liquid level in the underground tank, according to the invention. Such production of fumes and vapor could occur in prior art arrangements, particularly when the gasoline is warm, as during summer weather when the temperature can reach 85° F. or more, producing fumes and pressure in the tank to cause fumes and vapor to rise and be emitted.

It will be understood that various changes and modifications may be made from the preferred embodiments discussed above without departing from the scope of the present invention, which is established by the following claims and equivalents thereof.

The inventor claims:

1. A containment system for a filling station to prevent outflow of fumes from an underground tank, a drop tube and containment box, and to direct fuel input via the drop tube to the tank, said system comprising:

an underground fuel tank, a riser pipe extending from the tank to the containment box, and a drop tube within the riser pipe and extending below a fuel level in the tank to introduce fuel therebelow, said riser and drop tube being closed at their upper end portions to prevent passage of fumes therebetween and emissions therefrom, whereby fuel input to the tank and any in the containment box flow directly via the drop tube to beneath the surface of fuel in the tank, and fumes are not emitted between the riser pipe and the drop tube, and liquid fuel cannot pass downwardly in the riser pipe and the drop tube.

2. A system according to claim 1, wherein:

an annular passage defined between the riser pipe and the drop tube is closed by a resilient annular seal to prevent passage of fumes and to prevent passage of any liquid fuel therebetween.

3. A system according to claim 2, wherein:

a drop tube has an outwardly extending flange at its upper end portion and overlying the upper end of the riser, and the resilient seal is compressed therebetween.

4. A system according to claim 2, wherein:

the containment box is disposed at an upper end portion of the riser pipe, and on a mounting member threadedly disposed on an upper end of the riser pipe.

5. A system according to claim 1, wherein:

the containment box is disposed at an upper end portion of the riser pipe, and on a mounting member threadedly disposed on an upper end of the riser pipe.

6. A system according to claim 5, and further including:

a jam nut threadedly mounted in the mounting member and rotatable to depress the resilient annular seal between the flange and the upper end of the riser pipe, whereby passage of fumes between the riser pipe and the drop tube and emission thereof, is prevented, and liquid fuel is prevented from passing therebetween to the tank.

7. A system according to claim 6, and further including:

a containment valve at the containment box and operable to drain fuel therefrom via the drop tube to beneath the level of fuel in the underground tank.

8. A system according to claim 1, and further including:

a containment valve at the containment box and operable to drain fuel therefrom via the drop tube to beneath the level of fuel in the underground tank.

9. A containment system according to claim 1, wherein said drop tube extends to within 4" of the bottom of the underground tank.

10. A containment system for an underground fuel tank, a drop tube extending therefrom, and a containment box at an upper end of the drop tube, said system comprising:

an underground fuel supply tank, a riser pipe extending upwardly from the tank to the containment box, a mounting member supporting the containment box at an upper end of the riser pipe, said drop tube being concentric within the riser pipe and extending below a surface level of fuel in the tank, and sealing means between the upper end portions of the riser pipe and the drop tube to prevent passage of liquid fuel therebetween to the tank and fumes therebetween, and to pass liquid fuel via the drop tube to beneath a level of fuel in the tank.

11. A system according to claim 10, wherein:

flow of fluid between the riser pipe and drop tube is prevented, and excess fuel passes from the containment box via the drop tube to below a liquid level of fuel in the tank to minimize fumes emission.

12. A system according to claim 11, wherein:

an outwardly extending flange of the drop tube and an end of the riser pipe compress a resilient seal therebetween to prevent emission of fumes and passage of fuel therebetween to prevent fumes emission and passage of fuel to impact a fuel surface in the tank to produce fumes.

13. A containment system according to claim 11, wherein:

the containment valve is operable to drain any fuel from the containment box via the drop tube to the tank without liquid agitation or fumes production.

14. A containment system according to claim 9, wherein said drop tube extends to within 4" of the bottom of the underground tank.

15. A system according to claim 10, wherein:

an outwardly extending flange of the drop tube and an end of the riser pipe compress a resilient seal therebetween to prevent emission of fumes and passage of fuel therebetween to prevent fumes emission and passage of fuel to impact a fuel surface in the tank to produce fumes.

16. A containment system according to claim 10, wherein:

the containment valve is operable to drain any fuel from the containment box via the drop tube to the tank without liquid agitation or fumes production.

* * * * *